US009708875B2

(12) United States Patent
Lim et al.

(10) Patent No.: US 9,708,875 B2
(45) Date of Patent: Jul. 18, 2017

(54) WELLHEAD PRESSURE PLUG

(71) Applicant: Nustar Technologies Pte Ltd, Singapore (SG)

(72) Inventors: Ah Chai Lim, Singapore (SG); Chamal Jayanath Seneviratne, Singapore (SG); Kyaw Thet, Singapore (SG); Kim Kok Goi, Singapore (SG); Nur Adlina Binte Suhaimi, Singapore (SG); Sim Guan Teo, Singapore (SG)

(73) Assignee: NUSTAR TECHNOLOGIES PTE LTD, Singapore (SG)

( * ) Notice: Subject to any disclaimer, the term of this patent is extended or adjusted under 35 U.S.C. 154(b) by 297 days.

(21) Appl. No.: 14/446,300

(22) Filed: Jul. 29, 2014

(65) Prior Publication Data

US 2015/0034338 A1 Feb. 5, 2015

Related U.S. Application Data

(60) Provisional application No. 61/859,781, filed on Jul. 30, 2013.

(51) Int. Cl.

| | |
|---|---|
| ***E21B 34/02*** | (2006.01) |
| ***E21B 33/035*** | (2006.01) |
| ***E21B 33/12*** | (2006.01) |
| ***E21B 34/04*** | (2006.01) |

(52) U.S. Cl.
CPC ..... *E21B 33/035* (2013.01); *E21B 33/12* (2013.01); *E21B 34/04* (2013.01)

(58) Field of Classification Search
USPC ..... 166/386, 97.1
See application file for complete search history.

(56) References Cited

U.S. PATENT DOCUMENTS

| | | | | |
|---|---|---|---|---|
| 4,121,660 | A * | 10/1978 | Koleilat | E21B 23/02 166/123 |
| 2009/0211749 | A1* | 8/2009 | Nguyen | E21B 23/00 166/75.11 |
| 2011/0011598 | A1* | 1/2011 | Nguyen | E21B 23/01 166/386 |

* cited by examiner

*Primary Examiner* — Taras P Bemko
(74) *Attorney, Agent, or Firm* — Horizon IP PTE. LTD.

(57) ABSTRACT

A wellhead plug and a method for using a wellhead plug are presented. The ahead plug includes a plug body having at least a locking module, multiple sealing members, and a threaded connection tool. The wellhead plug according to the present disclosure offers multiple advantages over existing technologies. For example, the device may serve duplex roles as a wellhead pressure plug and/or a connection test tool. The device may, for example, serve as a blowout preventer (BOP) connection test tool, as well as an emergency drill pipe hang off tool (EDPHOT). This Abstracts submitted with the understanding that it will not be used to interpret or limit the scope or meaning of the claims.

20 Claims, 17 Drawing Sheets

WELLHEAD PRESSURE PLUG

CROSS-REFERENCE TO RELATED APPLICATION

This application claims the priority benefit of U.S. Provisional Application Ser. No. 61/859,781, filed on Jul. 30, 2013. All disclosures are incorporated herewith by reference.

BACKGROUND in an offshore drilling process, a pipe conduit may connect a subsea well to a surface drilling facility for transport of produced drilling fluids away from the well, thereby preventing drilling fluids from leaking into the water. Pressure control stacks, such as a blowout preventer stack, are used on wellheads during drilling operations to prevent uncontrollable escape of crude oil and/or natural gas due to relatively high pressure in the well. A subsea wellhead system providing structural and pressure-containing interface for the drilling and production equipment also serves to retain oil and/or gas within a temporarily abandoned well.

Offshore drilling presents environmental risks and safety challenges from produced hydrocarbons, materials used during the drilling operation, and adverse weather conditions. Consequently, there are stringent demands to the control and containment of the well during drilling, production and intervention work. Development of subsea technology has increased the demand of multipurpose equipment to increase work and environmental safety, while maintaining the economic feasibility of exploiting subsea hydrocarbons.

From the foregoing discussion, there is a desire for improved well containment and equipment testing components, which can enhance the safety and efficiency of offshore drilling operations.

SUMMARY

Embodiments generally relate to a device. In one embodiment, a plug is disclosed. The plug includes a protective cap portion having a slotted interface. A plug body is attached below the cap portion. The plug body includes upper and lower plug body, wherein a locking module is disposed between the upper and lower plug body. An upper portion of an annular mandrel is housed within the conical cap and plug body while a lower portion of the mandrel is exposed below the lower plug body. A valve assembly is disposed within a hollow profile of the mandrel.

In another embodiment, a method of using a device is disclosed. The method includes using a running tool to insert a wellhead plug into wellhead housing. The plug is landed within the wellhead housing and on a landing shoulder disposed below a wellhead opening. A downward load is applied on the running tool to activate a locking module and first and second sealing members of the plug to form a wellhead pressure seal. Activating the locking module also activates the first sealing member. A mandrel is rotated to lock the plug in an activated profile within the wellhead and the running tool is removed.

These and other advantages and features of the embodiments herein disclosed, will become apparent through reference to the following description and the accompanying drawings. Furthermore, it is to be understood that the preferred embodiments described herein are not limiting examples of how the invention may be employed.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Embodiments generally relate to devices, such as wellbore or wellhead sealing devices. More particularly, some embodiments relate to wellhead plugs. Such plugs, for example, can be locked to the inside of a wellhead. In one embodiment, the plug can be locked into an internal cam profile of a partially completed wellhead to serve as a primary wellhead seal or as one of multiple wellhead seals. For example, the plug provides a retrievable (or temporary) pressure barrier to a subsea wellhead.

A wellhead sealing device according to the present disclosure offers multiple advantages over existing technologies. For example, the device may serve duplex roles as a wellhead pressure plug and/or a connection test tool. The device may, for example, serve as a blowout preventer (BOP) connection test tool, as well as an emergency drill pipe hang off tool (EDPHOT).

In one embodiment, the plug is designed to withstand bi-directional pressure loads and enable drill pipe hang off. For example, the plug is designed to withstand pressure loads from within as well as outside the wellbore. In one embodiment, the plug is designed to seal against pressure loads of up to about 15,000 PSI in a downhole and/or uphole direction and enable hang off for drill string and bottom hole assembly (BHA). Providing a plug which can withstand higher pressures may also be useful. The plug may serve various functions. For example, the plug may serve as a primary barrier to wellhead pressure for a temporarily abandoned well, or as a test tool for facilitating blowout preventer (BOP) and riser connection tests while forming a wellhead seal. The plug can also support the hanging load of the drill string and BHA while forming a wellhead seal. It is to be appreciated that the plug may perform the aforementioned functions in any combinations or combination thereof is also to be understood that the dimensions of the plug may be adjusted to complement a range of wellheads with different internal profiles depending on design requirements.

Figure 1A:
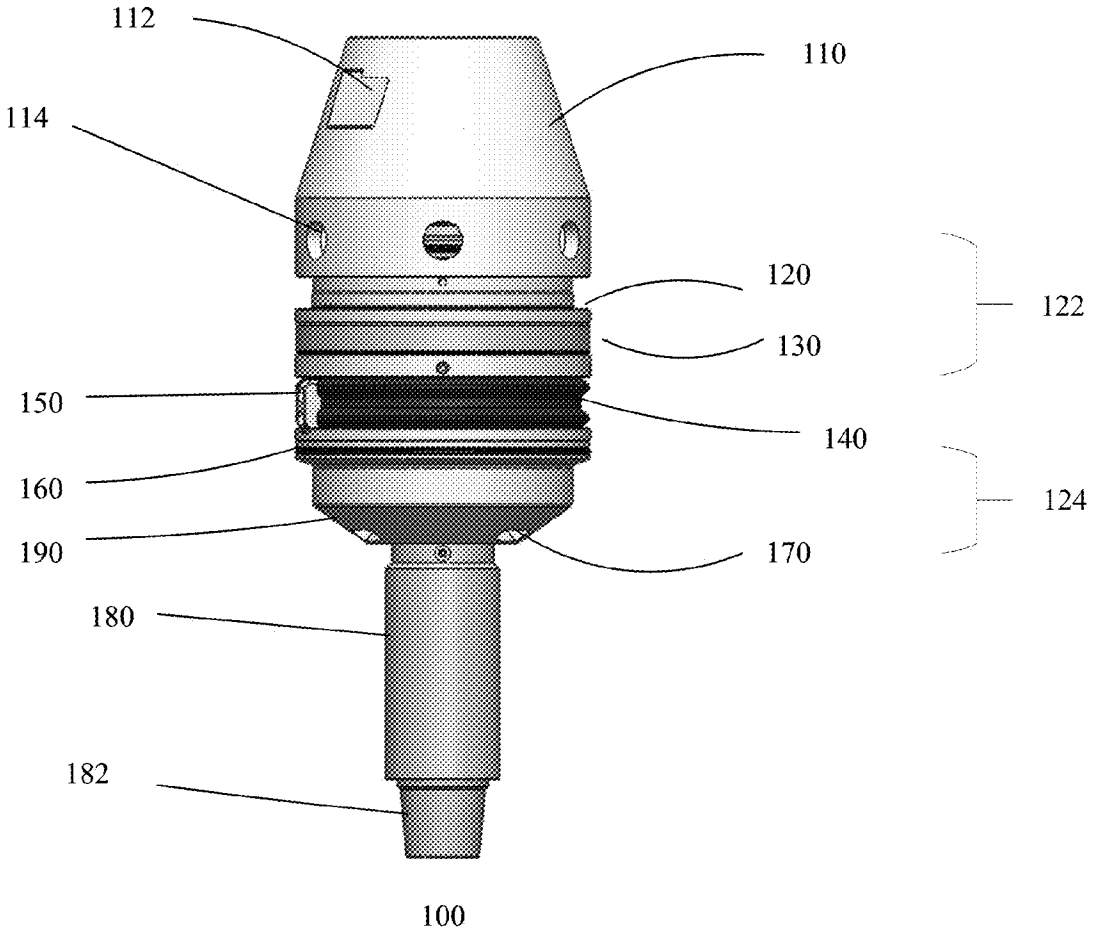
FIG. 1A shows a frontal view of an embodiment of a device.
Figure 1B:
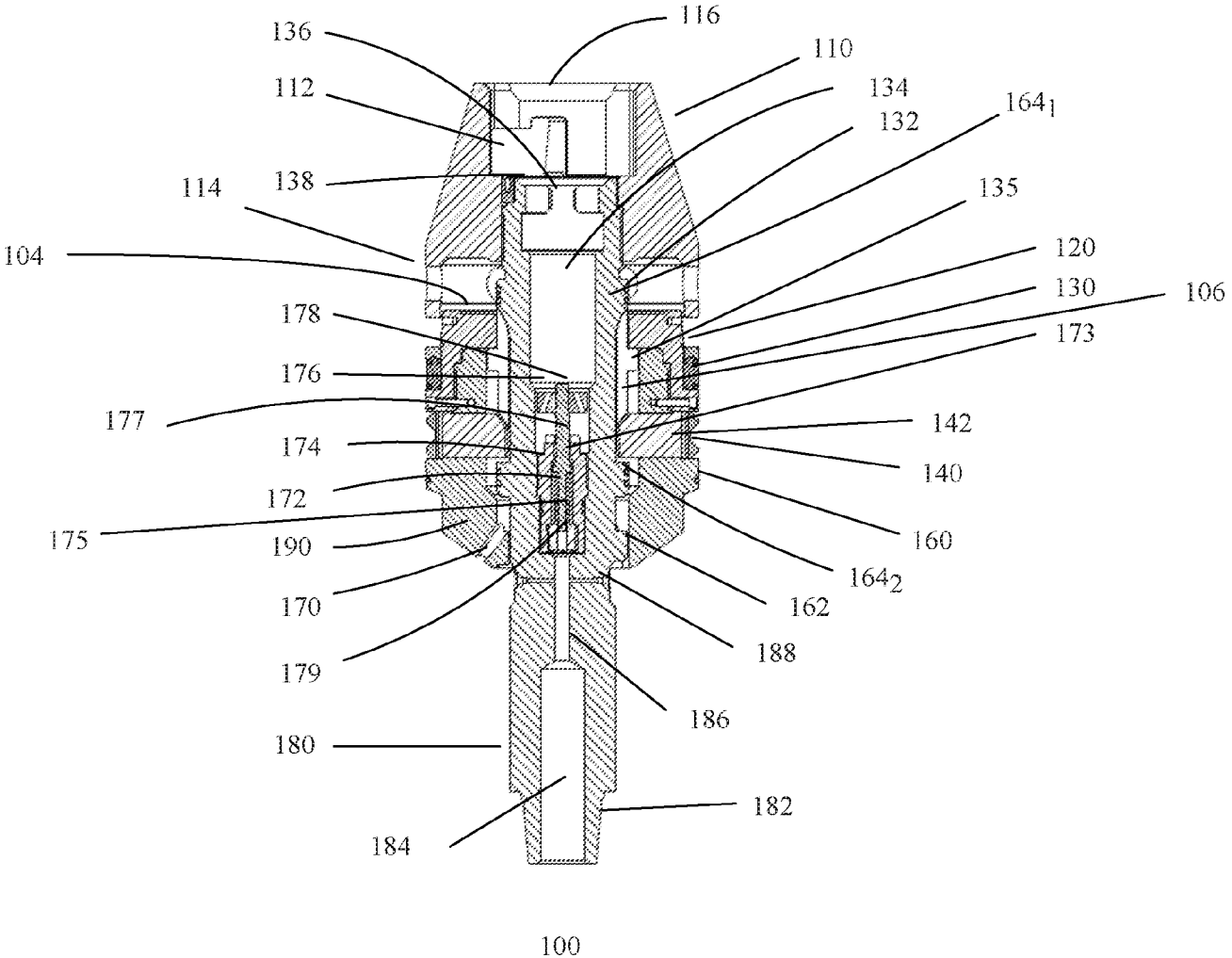
FIG. 1B shows a cross-sectional view of an embodiment of a device.

FIGS. 1A and 1B show an embodiment of a device. More specifically, FIGS. 1A and 1B show frontal and cross-sectional views of a wellhead plug 100 respectively. In one embodiment, the plug profile is a running plug profile. For example, the plug is in an unlock plug profile.

In one embodiment, the plug 100 is a low alloy steel (LAS) plug. For example, the plug 100 is a high strength low alloy steel (HSLA) plug with a tensile strength of at least 120 KSI. The LAS include, for example, alloyants such as Cr, Ni, Mo or V. Other suitable types of alloyants, such as Mn, Si or B, can also be used. In one embodiment, the plug 100 includes multiple sealing members. For example, the plug may be deployed as a wellhead sealing device and/or a BOP connection test device.

As shown in FIG. 1A, the top portion of the plug 100 includes a conical cap 110 with a slotted cap interface 112 about a beveled top portion of the cap and a plurality of port holes 114 about equally displaced around a flanged bottom portion of the cap 110. In one embodiment, the slotted cap interface 112 includes vertical and horizontal grooves and a latch disposed atop an end of the horizontal grooves. The slotted cap interface interacts with a running tool to activate various mechanisms of the plug, such as locking modules and sealing members. The conical cap is, for example, a HSLA cap. A conical cap made of other LAS may also be useful. Preferably, the cap is formed of the same material as the plug body. In one embodiment, the cap is a singular construct disposed above an upper plug body. For example, the cap is threaded to an upper portion of a generally cylindrical plug body and secured in position by a bolt (not shown). The bolt, for example, secures the threaded cap to the plug body. Other methods to attach the cap to the plug body may also be useful. For example, connecting the cap to the plug body through a mandrel may also be useful. The conical cap 110 serves to protect the plug against physical impacts. For example, the conical cap serves to deflect the impact of BOP bottom connector during attachment and/or detachment of the BOP bottom connector from the wellhead.

The external circumference of the plug body includes a metal gauge ring 120 disposed above a first sealing member 130. The metal gauge ring and first sealing member is, for example, disposed about an upper plug body 122 and above a locking module 140. In one embodiment, the metal gauge ring is vertically displaceable between the first sealing member 130 and an elastomeric ring, such as a nitrite ring. The elastomeric ring is, thr example, disposed above the metal gauge ring 120. For example, the elastomeric ring limits upward movement of the metal gauge ring. In one embodiment, the metal gauge ring serves as a retaining ring for the first sealing member. The first sealing member 130 is, for example, an energizable (or expandable) bulk sealing ring. In one embodiment, the metal gauge ring is weighed down to energize the first sealing member. For example, the first sealing member is energized against a wellhead internal diameter to form a first wellhead pressure seal. In another embodiment, the metal gauge ring is displaced upwardly to de-energize the first sealing member. For example, the de-energized first sealing member displaces the metal gauge ring upward.

A spring-loaded anti-rotation component 150, a locking module 140 and a second sealing member 160 are disposed on the external circumference of the plug body and below the first sealing member 130. The second sealing member is, for example, disposed about a tower plug body 124 and below the locking module 140. In embodiment, the locking module is an expandable open ring which locks the plug in a functional position within the wellhead. The locking module 140, for example, is an expandable metal ring. In one embodiment, the second sealing member 160 is an energized (or expanded) sealing ring. For example, the second sealing member is energized against the wellhead internal diameter to form a second wellhead pressure seal. In one embodiment, the second sealing member 160 has a narrower surface than the first sealing member 130. Having other dimensions of first and second sealing members may also be useful. For example, having first and second sealing members with similar surface dimensions may also be useful.

The anti-rotational component 150 extends slightly from the external circumference of the plug body. For example, the anti-rotational component extends slightly from the generally cylindrical plug body. In one embodiment, the anti-rotational component 150 is a spring-loaded stopper. For example, the spring-loaded stopper is an anti-rotation key which engages into an anti-rotation slot within the wellhead internal diameter to restrict the plug from rotating. The lower plug body includes a beveled base 190. The beveled base 190 includes multiple diagonal flutes 170 about equally displaced around the base 190. In one embodiment, the port holes 114 and flutes 170 function in combination to facilitate the process of deploying the plug into the wellhead. For example, the port holes and flutes reduce fluid resistance within the riser during plug deployment into the internal profile of a subsea wellhead. The port holes and flutes are, for example, flow-by holes.

As shown in FIG. 1B, an annular cap opening 116 is beveled to form a bowl-shaped cap receptacle 138. In one embodiment, an annular mandrel opening is disposed within a cap housing below the cap opening. An annular mandrel body extends downwardly from the mandrel opening to a tapered end 182. For example, the mandrel body extends through the internal profile of the plug body. In one embodiment, the annular mandrel includes upper and tower mandrel portions. For example, the upper mandrel portion is housed within the conical cap and plug body and the lower mandrel portion is an exposed stem portion 180 below the beveled base. For example, the mandrel connects the conical cap to the plug body.

The upper mandrel portion includes a hollow profile. In one embodiment, the hollow profile houses a valve assembly and includes a top mandrel opening disposed about the base of the slotted cap interface 112 and beveled to form a bowl-shaped mandrel receptacle 138. A slotted mandrel interface 136 is formed about a top portion of the hollow profile. In one embodiment, the slotted mandrel interface 136 serves to facilitate BOP connection tests. For example, a plug running or retrieval tool is slidably mounted into the slotted mandrel interface for BOP connection pressure test before plug retrieval. Other tools may also be mounted for BOP connection test.

The lower mandrel or stem portion includes a bottom mandrel opening disposed at the tip of the tapered end 182. For example, the bottom mandrel opening extends into abroad axial bore 184. The stem portion includes abroad axial bore 184 in communication with a narrow axial bore 186 and annular channels 188 disposed adjacent to and in communication with the narrow axial bore 186. In one embodiment, the narrow axial bore 186 extends from the stem portion to the upper mandrel portion. For example, the bottom of the mandrel hollow profile is in communication with the narrow and broad axial bores and annular channels. In one embodiment, the broad axial bore serves as a primary inlet of a pressure ventilation pathway. For example, the broad axial bore serves as a primary inlet to ventilate downhole pressure equalization.

In one embodiment, the stem portion serves as a drill pipe hang off tool. For example, the stem portion serves to hang off the BHA during an emergency evacuation. In one embodiment, the tapered end 182 is a threaded end which forms a threaded connection pin of the stem portion. For example, the threaded end forms a threaded connection to a drill string or BHA. Other methods to connect the drill string to the stem portion may also be useful. In one embodiment, the annular channels extend perpendicular from the axial bore. The annular channels are, for example, secondary inlets of a pressure ventilation pathway. For example, the annular channels serve as secondary inlets to ventilate downhole pressure when the bottom mandrel opening is enclosed. For example, threading the tapered end to a drill string also encloses the bottom mandrel opening.

In one embodiment, the external profile of the annular mandrel includes first and second beveled mandrel shoulders $164_1$-$164_2$ formed around upper and lower portions of the upper annular mandrel portion and multiple mandrel lugs 162 disposed below the second mandrel shoulder and housed within the beveled base of the tower plug body. The first and second beveled mandrel shoulders $164_1$-$164_2$ include a pair of radial grooves for seating two inner sealing elements 132. In one embodiment, the inner sealing elements 132 form internal pressure seals of an activated plug.

In one embodiment, a plurality of recesses are disposed below the first mandrel shoulder $164_1$ and along a mandrel hanger and flange. The recesses define a mandrel flange having a series of shortened or discontinuous flange edges and a series of mandrel hangers having a beveled bottom edge. For example, each mandrel hanger 106 includes a shorted mandrel flange disposed about the center of the mandrel hanger 106. In one embodiment, the beveled edges of the hangers 106 are rested atop a wedge end of support dogs 142. For example, inward tension transferred from the support dogs keep the mandrel in an upward or running position. In one embodiment, upward movement of the mandrel flange is limited by an inner protruding rim 104 of the upper plug body. For example, the inner protruding rim prevents the mandrel from being displaced out of the plug body. In one embodiment, the mandrel flange its the upward vertical displacement of the annular mandrel 134 to a first position. For example, the annular mandrel is retained within the plug body during plug deployment and retrieval.

In one embodiment, multiple mandrel lugs 162 abut the bottom of the upper mandrel portion. For example, the mandrel lugs are disposed within a beveled base housing. In another embodiment, the mandrel lugs are rotated into respective beveled base latches. For example, the lugs are latched to restrain the lugs from upwardly movement. Engaging the lugs into the latches, for example, also locks the mandrel in a downward or activated position. The lugs are, for example, locking lugs. In one embodiment, the lugs 162 include a locking port and a port plug disposed at the bottom of the port. For example, the port plug encloses the bottom end of the locking port.

A spring-loaded valve assembly is housed within the hollow profile of the upper mandrel 134. In one embodiment, the valve assembly is disposed at the bottom of the hollow profile. The valve is, for example, a check valve. The valve includes a slotted valve wheel 176 and a valve spring housing 174 which houses a compression spring 172 above an inner valve mandrel 179. The slotted valve wheel 176 is disposed at the top end of a valve stem 178 which extends downwardly into the valve spring housing 174. The valve stem 178 includes an upper portion 177 interconnected to a lower valve portion 175. For example, the upper valve portion is a valve shaft and the lower valve portion is a valve leg. The valve shaft 177 includes a beveled end 173 disposed between the compression spring 172 and the inner surface of the valve spring housing 174. In one embodiment, the beveled end 173 includes a radial groove for seating a valve sealing element. The valve sealing element is, for example, an energized valve sealing ring similar to the inner seating elements). In one embodiment, the beveled end 173 is displaced upwardly against the spring housing 174 inner surface by an upward tension provided by the spring 172. For example, the valve sealing ring is energized against the inner surface of the spring housing 174 to form a valve pressure seal or a closed valve. The valve leg portion 175 extends downwardly from the beveled end 173 into the bore of the valve mandrel 179. The compression spring 172, for example, surrounds the valve leg.

The anti-rotational component and locking module 140 are disposed along a ledge of the lower plug body. The locking module 140 is, for example, a locking ring having an outer cam profile. In one embodiment, the locking ring is in contact with multiple support dogs 142. In one embodiment, the locking ring is an inward biased ring. In one embodiment, the locking ring is an open locking ring. For example, the anti-rotation component is disposed within the opening of the locking ring.

In one embodiment, the support dogs are housed in windows of the plug body and adjacent to the locking module 140. For example, the support dogs are disposed between the upper mandrel portion and locking ring. The support dogs serve to expand the locking ring to lock the plug in its functional position within the wellhead bore. For example, the support dogs are horizontally displaceable to expand the locking ring.

Figure 2A:
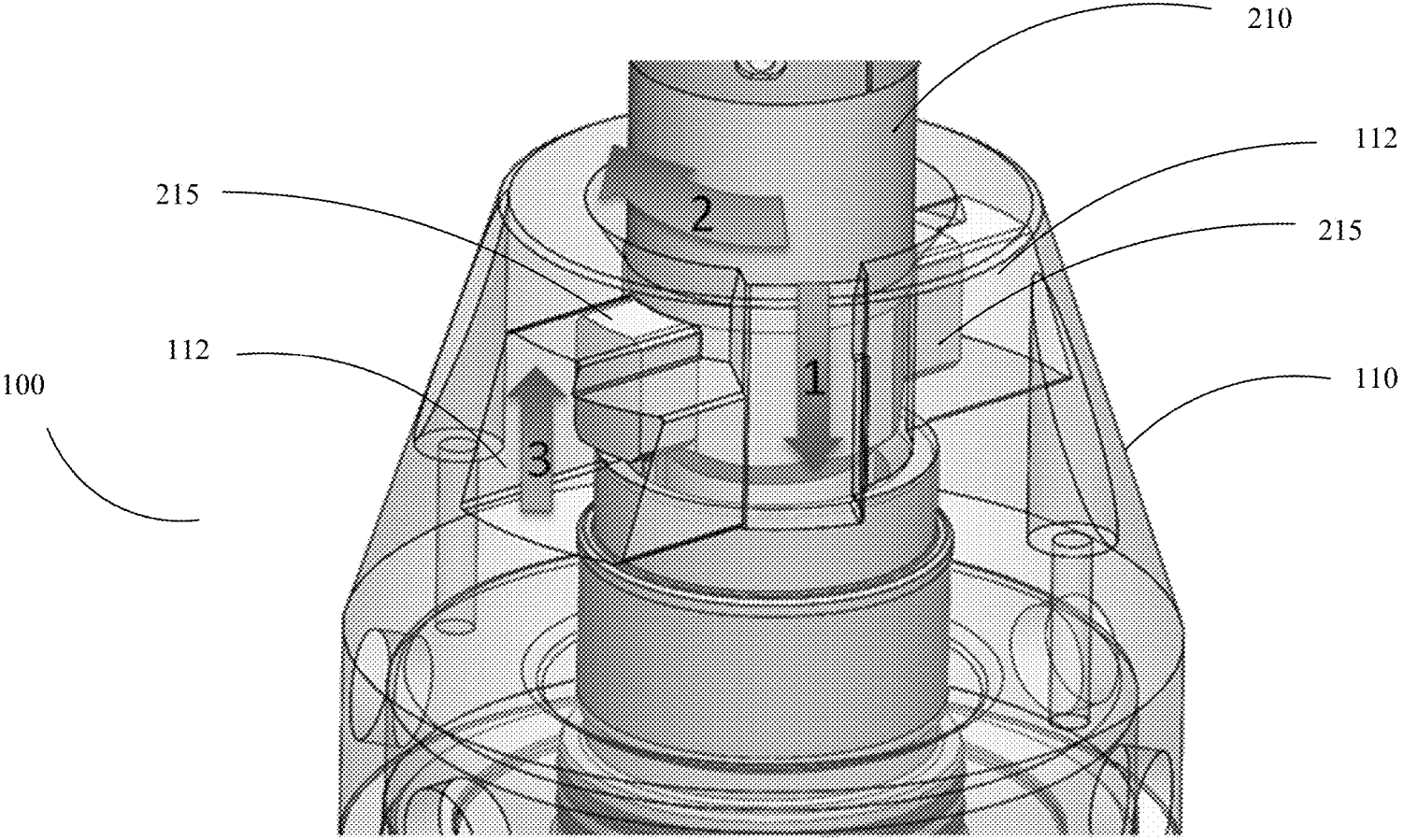
FIGS. 2A-2D show an embodiment of a process for deploying a device.
Figure 2B:
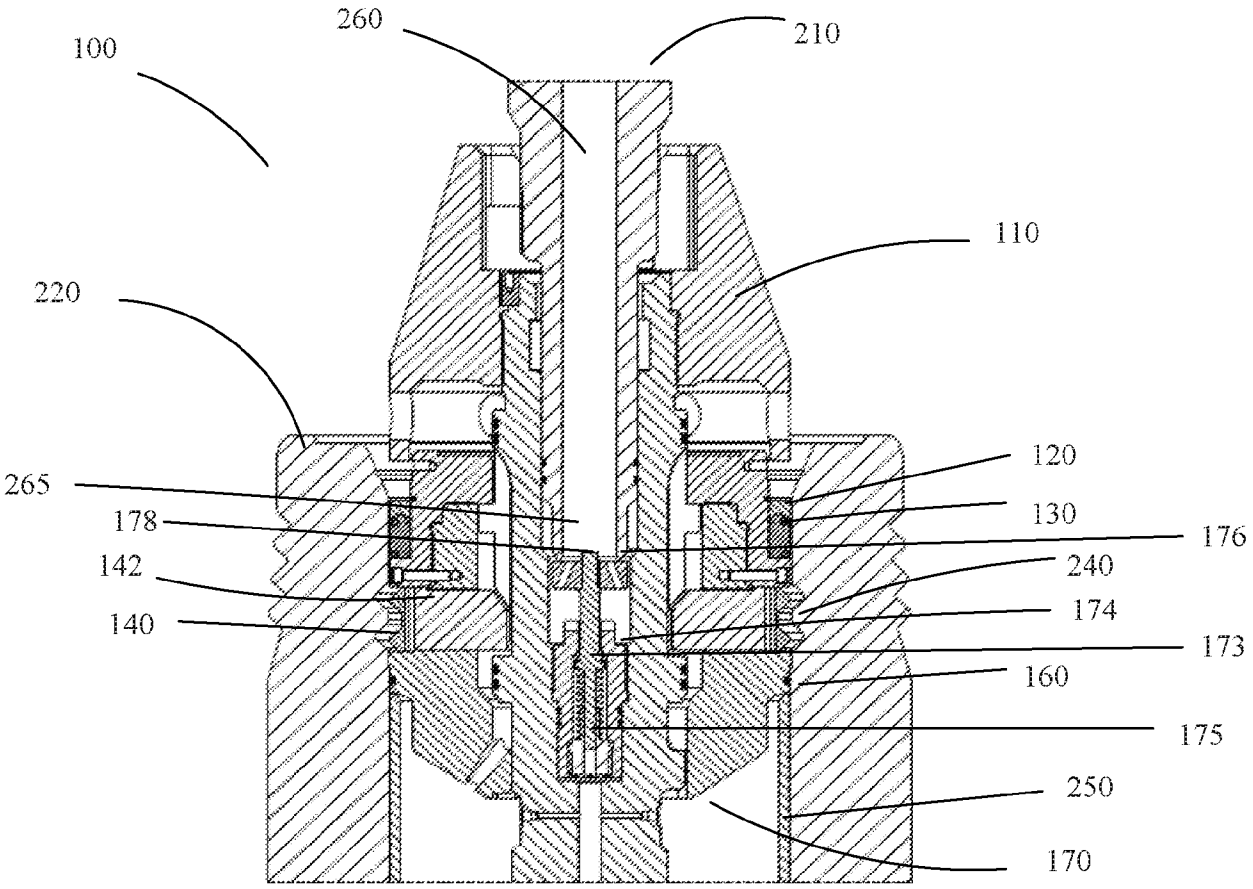
Figure 2C:
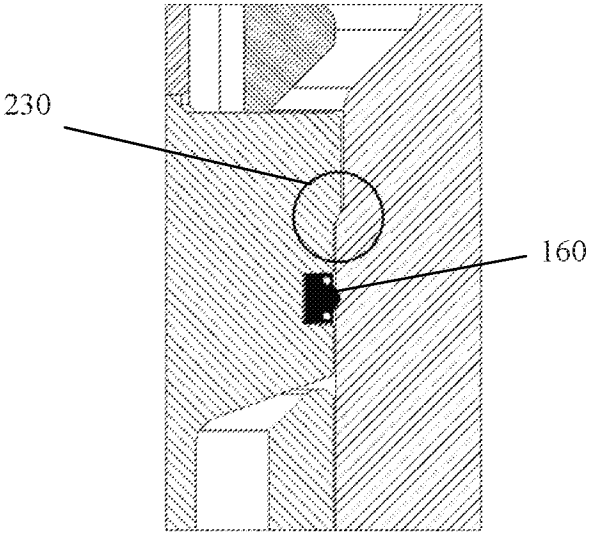

FIGS. 2A-2C show an embodiment of a process for deploying a device. In particular, FIGS. 2A-2C show a process tier deploying a wellhead plug with a deployment tool. The plug is similar to that described in FIGS. 1A-1B. Common elements may not be described or described in detail.

FIG. 2A shows the mating process of a running tool with the plug 100. In one embodiment, the running tool is mated with the annular mandrel. For example, the running pin 210 (or pin) of the running tool is inserted into the cap opening. In one embodiment, the running tool serves as a plug deployment tool and a plug actuating tool. For example, the running tool deploys the plug into the wellhead and activates the locking and sealing elements of the plug to form a wellhead seal.

The pin 210 includes a pair of angular abutments 215 which interact with the slotted interface 112 of the conical cap 110. When the pin 210 is mated to the mandrel, the angular abutments 215 are slidably mounted into the slotted interface 112 of the cap. In one embodiment, the angular abutments are engaged into a latch of the slotted interface through a mounting process. The mounting process, for example, includes a series of motions to slide the abutments along the grooves of the interface 112. In one embodiment, the mounting process includes a first motion which slides the angular abutments 215 downwardly into the interface along vertical grooves; a second motion rotates the pin iii a clockwise direction to slide the angular abutments along horizontal grooves; a third motion slides the angular abutments upwardly along a vertical wall of the horizontal grooves to engage the abutments into the latch. For example, the series of motions are guided by the walls of the grooves. In one embodiment, the latched running pin allows the running tool to deploy into a subsea wellhead and land the plug on landing shoulders within the wellhead. The running plug is, for example, in a running profile similar to that shown in FIG. 1B.

In one embodiment, a plug retrieval process is similar to that of the mounting process. For example, the plug retrieval pin is similarly latched to the slotted interface to retrieve the plug from the wellhead. The slotted interface is, for example, a J-slot interface. Other types of interface may also be useful. Other configurations of mounting and retrieval process may also be useful.

FIG. 2B shows an embodiment of the plug 100 disposed in the functional position within the bore of the wellhead. The plug is, for example, deployed in a running or unlock plug profile. Other deployment profiles may also be useful. In one embodiment, the plug 100 is deployed within a wellhead housing 220. For example, the plug is deployed within a high pressure wellhead housing. The external circumference of the plug body includes locking module 140 and sealing elements 130 and 160. In one embodiment, the locking and sealing elements are activated to form a primary wellhead pressure seal. For example, the locking module locks the plug 100 in position and the first and second sealing members 130 and 160 are energized against the wellhead inner diameter to form first and second wellhead pressure seals.

The plug body has an outer diameter that is slightly narrower than the bore of the wellhead. The unlock plug profile includes support dogs 142 and a locking module 220 that are in a retracted position as the plug 100 is lowered into position in an area adjacent to the wellhead's annular grooves 240. The conical cap 110 is in a first position away from the metal gauge ring 120 and the first sealing member 130. The gauge ring is, for example, a retaining ring for the first sealing member. The gauge ring 120 facilitates energizing the first sealing member 130. In one embodiment, the first sealing member 130 is a first elastomeric sealing ring. The first elastomeric sealing ring is, for example, a nitrile rubber sealing ring with metal insert rings. Other types of sealing ring may also be useful. For example, the sealing ring may be of other types of elastomers or polymers, such as hydrogenated nitrile (HNBR), carboxylated nitrile (XNBR), fluorocarbon elastomers (VITON) and tetrafluoroethylyene-propylene (ALFAS).

In one embodiment, the first sealing member 130 is a de-energized sealing element. For example, the de-energized sealing element is about level with the circumference of the metal gauge ring. In one embodiment, a downward load energizes the first sealing member 130 to form a pressure seal. For example, the first sealing member forms a primary seal against BOP test pressure. In one embodiment, the first sealing member 130 forms a primary seal against uphole pressure and also a secondary seal against downhole pressure. For example, the first seating member 130 forms a primary seal against up to about 15,000 PSI of uphole pressure.

For example, the metal gauge ring is vertically displaceable to transfer a downward force to energize the first sealing ring against the wellhead inner diameter. In one embodiment, vertical displacement of the gauge ring is confined between a nitrite ring and the first sealing member. For example, a nitrite sealing ring disposed around the circumference of the plug body and above the gauge ring and a bulk seal energization length limits upward and downward displacement of the gauge ring respectively.

The tower plug body includes a second sealing member 160 disposed in an annular groove below the locking module 140. In one embodiment, the second sealing member 160 is an energized elastomeric sealing element. For example, the second sealing member 160 is a pressure-energized nitrite rubber sealing ring. Other types of sealing material may also be useful. For example, the sealing ring may be of other types of elastomers or polymers, such as HNBR, XNBR, VITON and ALFAS. The energized second sealing member forms a slight protrusion extending out from the flanged portion of the lower plug body. The protrusion is sufficient to enable the plug 100 to be lowered into the wellhead bore and to allow the second sealing member to energize against the wellhead inner diameter to form a second wellhead pressure seal. For example, the second sealing member forms a primary seal against wellbore pressure. In one embodiment, the second sealing member 160 forms a primary seal against downhole pressure and also a secondary seal against uphole pressure. For example, the second seating member 160 forms a primary seal against up to about 15,000 PSI of downhole pressure.

In one embodiment, the latched pin 210 is partially mated to the plug 100. For example, the latching the angular abutments 215 to the slotted cap interface partially disposes the pin within the hollow profile of the annular mandrel 134. The pin includes a pressure duct 260 that is in communication with an opening at the nose of the pin. The pin nose 265 is in contact with the slotted valve wheel 176 to dispose the pressure duct 260 directly above the slots of the valve wheel 176. In one embodiment, the pin nose forcibly displaces the valve wheel 176 and valve stem 178 downwardly. For example, the beveled end 173 of the upper valve shaft 177 is displaced partially away from the spring housing 174 inner surface. In one embodiment, partially displacement of the beveled end and valve sealing element away from the spring housing 174 inner surface opens the valve ventilation pathway. For example, the valve sealing element is partially displaced to define a partially open check valve. In one embodiment, the check valve is partially open during plug deployment. For example, the partially opened check valve facilitates plug deployment by reducing fluid resistance. Other configurations for the valve during deployment may also be useful. For example, having a fully opened check valve during plug deployment may also be useful.

In one embodiment, the plug is deployed to land on a landing shoulder along the inner diameter of the wellhead and above an adapter or adapter sleeve, such as a nominal seat protector (NSP) 250. The landed plug is, for example, not in contact with the NSP. Employing other types of adapter or adapter sleeve may also be useful. The plug is landed on a landing shoulder provided by the wellhead internal profile. In one embodiment, the landing shoulder is an annular landing shoulder sufficiently wide to restrict the plug body 110 from moving further downward through the wellhead housing 220. For example, a hanging step 230 disposed on the circumference of lower plug body and between the locking module and second sealing member is in contact with the landing shoulder, as shown in FIG. 2C.

In an alternative embodiment, the plug is landed on a landing shoulder provided by an adapter or adapter sleeve. For example, the beveled base 190 of the lower plug body is landed on an inner landing shoulder of a wear bushing. Employing other types of adapter or adapter sleeve that provide a landing shoulder may also be useful.

Figure 2D:
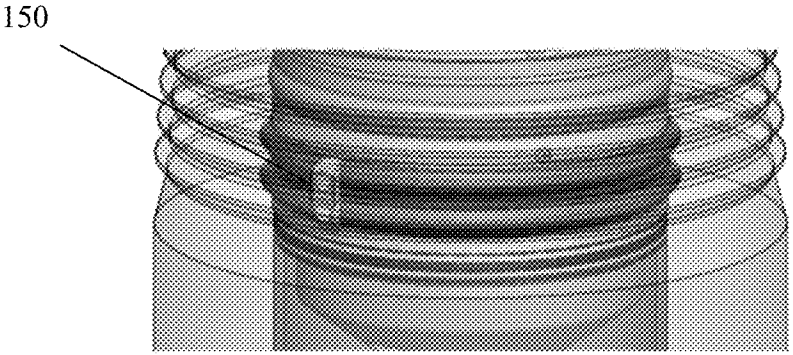

In one embodiment, the plug 100 is landed within the wellhead housing and rotated about the landing shoulders by the pin 210. Compression springs beneath the contoured surface of the protruding stopper may be forcibly compressed against the inner diameter of the wellhead bore to enable the stopper 150 to slide along the wellhead internal diameter and land the plug within the wellhead housing during the deployment process. In one embodiment, the landed plug 100 is rotated in a clockwise direction until the compressed stopper 150 expands into an anti-rotation slot within the wellhead housing, as shown in FIG. 2D. The stopper 150, for example, engages the anti-rotation slot to restrict further rotary motions of the plug 100. Rotating the plug 100 in other directions may also be useful. For example, rotating the plug 100 in anticlockwise direction to engage the stopper with the anti-rotation slot may also be useful.

Figure 3A:
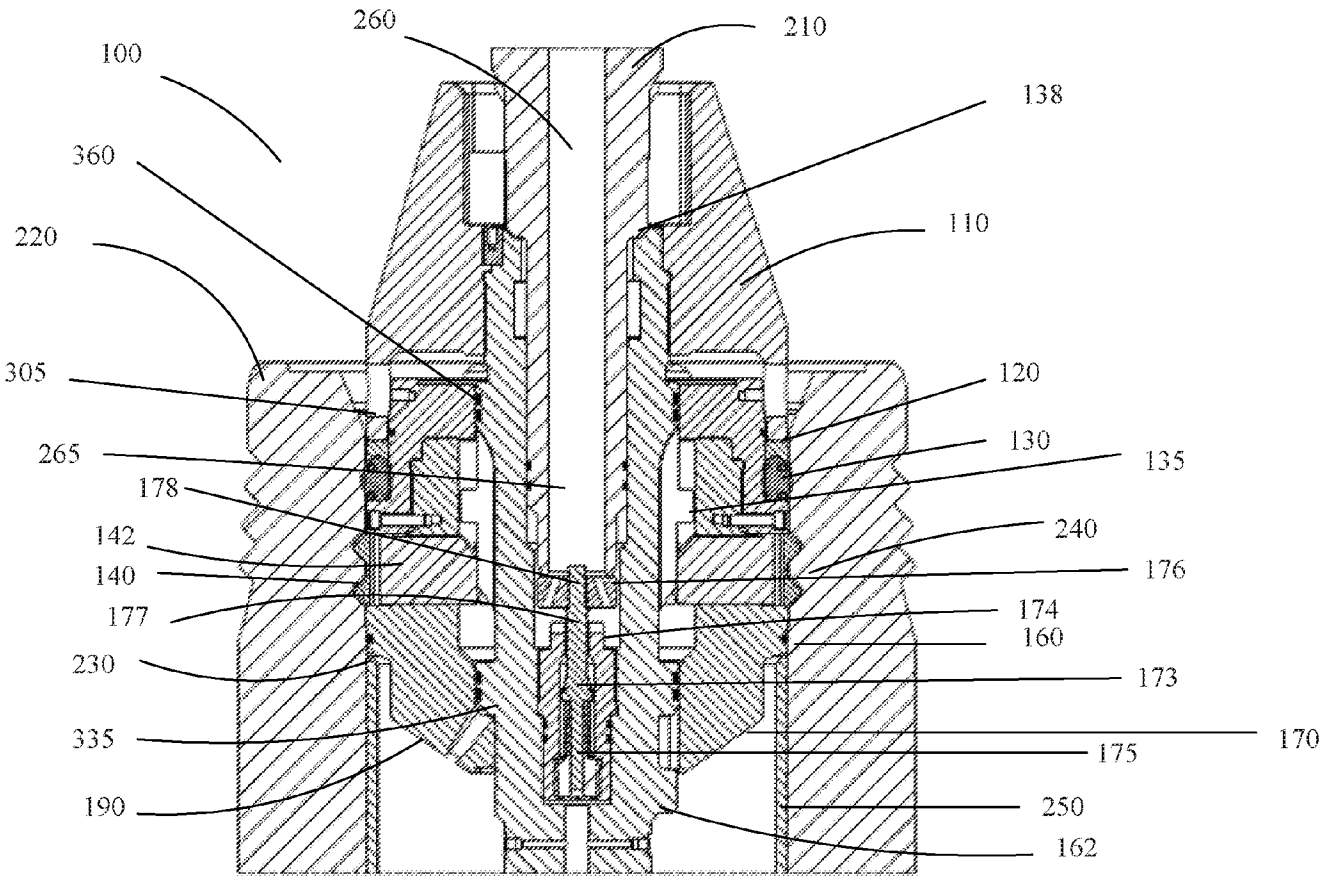
FIGS. 3A-3B show cross-sectional views of different embodiments of a device.
Figure 3B:
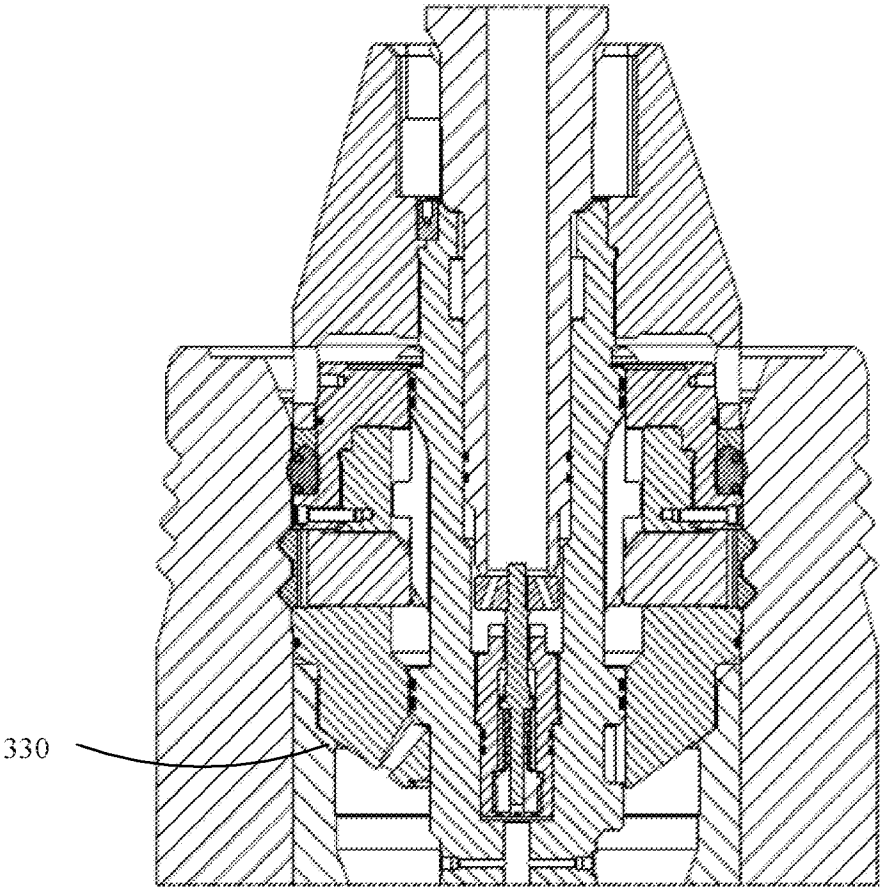

FIGS. 3A and 3B show a cross-sectional view of different embodiments of a device. In particular, FIGS. 3A and 3B show different embodiments of an activated (or locked) plug. An activation process is performed on an anti-rotated plug similar to that described in FIG. 2D. The activation process, for example, includes a controlled release of the running string weight set to weigh down on the annular mandrel. In one embodiment, the weighed down annular mandrel activates the locking module and the first sealing member. The plug is similar to that described in FIGS. 1-2D. Common elements may not be described or described in detail.

As shown in FIG. 3A the plug is landed within the wellhead housing with an NSP disposed below the plug landing shoulder. In one embodiment, the pin is displaced downwardly to activate the locking module 140 and first sealing member 130. For example, the pin is weighed down by the running string weight set to fully mate into the mandrel. The mandrel receptacle, for example, receives an annular beveled shoulder of the fully mated running pin. In one embodiment, the downward tension of the running string weight set is transferred from the running pin to weigh down the mandrel and conical cap. For example, the downward tension displaces the annular mandrel 134 and conical cap downwardly to activate the locking module 140 and first sealing member 130 respectively. As shown, the activated plug adopts a locked profile.

In one embodiment, the weighed down mandrel is displaced downwardly and the inner sealing rings 132 around the first and second beveled mandrel shoulders $\mathbf{164_1}$-$\mathbf{164_2}$ are similarly displaced. For example, the energized inner sealing rings are displaced downwardly to energize against the inner diameter of the upper and lower plug body and form inner pressure seals along the internal profile of the plug body. The mandrel lugs 162 are similarly displaced downwardly to the bottom of the beveled base housing and about level with the beveled base latch.

Downward displacement of the upper mandrel portion slides a beveled edge of the mandrel hanger 106 downward along the wedge end of the support dogs to displace the support dogs away from its retracted position. For example, the support dogs are displaced a length of the mandrel hanger 106. The support dogs are displaced outwardly to expand the locking module 140 which moves radially outward into the adjacent annular grooves 240 of the wellhead bore. The expanded locking module engages the annular grooves and locks the plug 100 in its functional position.

In one embodiment, the weighed down conical cap 110 is displaced to land the bottom cap rim 305 on the metal gauge ring 120 and transfer the downward tension to energize the first sealing member 130. For example, the first sealing member 130 is energized against the inner diameter of the wellhead bore to form a wellhead seal. In one embodiment, the downward tension is sufficient to overcome an elastomeric resistance of the first sealing member. For example, a downward tension of at least about 8 metric ton is required to energize the first sealing member 130. For example, a running string weight set of at least about 8 metric ton weighs down the conical cap to energize the first sealing member. Other sources of downward tension may also be used to energize the first sealing member.

In another embodiment, a drill string hanging off of the stem portion may also transfer a downward tension to energize the first sealing member. The hanging load, for example, transfers a downward tension to the cap through the mandrel 134. For example, the mandrel and conical cap are connected. Having other amounts of load to energize the first sealing member 130 may also be useful. For example, having a combined downward tension from the running string weight set and BHA hanging load may also be useful. The first sealing member 130 is pressure-energized to form a primary seal against uphole pressure. In one embodiment, the pressure-energized first sealing member 130 forms a primary seal during blowout preventer (BOP) connection test. The first sealing member 130, for example, seals against an uphole pressure load of up to about 15,000 PSI. Sealing against other amounts of pressure load may also be useful.

In one embodiment, the fully mated pin 210 displaces the beveled end 173 of the valve shaft away from the spring housing 174 inner surface from a partial displacement to a complete or full displacement. For example, the beveled end 173 and valve seating element is fully displaced from the spring housing 174 inner surface to define a fully open check valve. In one embodiment, an open check valve allows excess downhole pressure to be ventilated away from the well bore through the valve ventilation pathway.

In one embodiment, the plug is activated on a landing shoulder provided by the wellhead profile. For example, a hanging step disposed on the circumference of the lower plug body is in contact with the landing shoulder. In one embodiment, the plug is unseated from the landing shoulder when the locking module is expanded to engage into the wellhead annular grooves. For example, activating the locking module also lifts the plug off the landing shoulder of the wellhead profile. In such cases, the expanded locking module supports the plug in the functional position against upward or downward loads. For example, uphole or downhole pressure loads are supported by the locking module and adjacent support dogs instead of the landing shoulders. Supporting other types of loads may also be useful. In one embodiment, the locking module and support dogs support downward loads such as drill string hanging loads. For example, the expanded locking module supports upward or downward loads of up to about 200 metric ton. Supporting other amounts of loads may also be useful. For example, supporting loads of more than 200 metric ton may also be useful.

It is to be understood that upward loads include pressure load or tension or a combination thereof, while downward loads include pressure load or tension or weight set or a combination thereof. It is also to be understood that pressure loads include fluid or gas pressure loads.

In an alternative embodiment, the plug is landed on a landing shoulder provided by an adapter or adapter sleeve. For example, the plug is landed on all inner landing shoulder 330 provided by a wear bushing, as shown in FIG. 3B. Other types of adapter or adapter sleeve may also provide a landing shoulder. In one embodiment, activating the locking module does not unseat the plug from the landing shoulder. For example, activating the plug does not lift the plug off the landing shoulder of the wear bushing. In such cases, continued contact with the landing shoulder allows downward loads to be supported by the landing shoulder while upward loads are supported by the locking module and support dogs. The landing shoulder and/or locking module support loads of up to about 200 metric ton. For example, the landed plug is able to support downward loads of up to about 200 metric ton without relying on the locking module. The activated plug, for example, supports upward and downward loads such as pressure and/or hanging loads. Supporting other amounts of loads may also be useful. For example, supporting loads of more than 200 metric ton may also be useful.

In one embodiment, the plug forms a wellhead pressure seal in wellhead housing. For example, locking the plug in the functional position also exposes atop portion of the plug above the wellhead bore. In one embodiment, the conical cap of the activated plug is disposed above the wellhead bore and outside of the wellhead housing. In one embodiment, the exposed conical cap serves as a protective component. For example, the cap protects the upper plug body against the BOP wellhead connector during connector connect and disconnect operations. The cap may also protect the plug against other damaging elements. For example, the cap buffers the plug against external physical impacts.

Figure 4A:
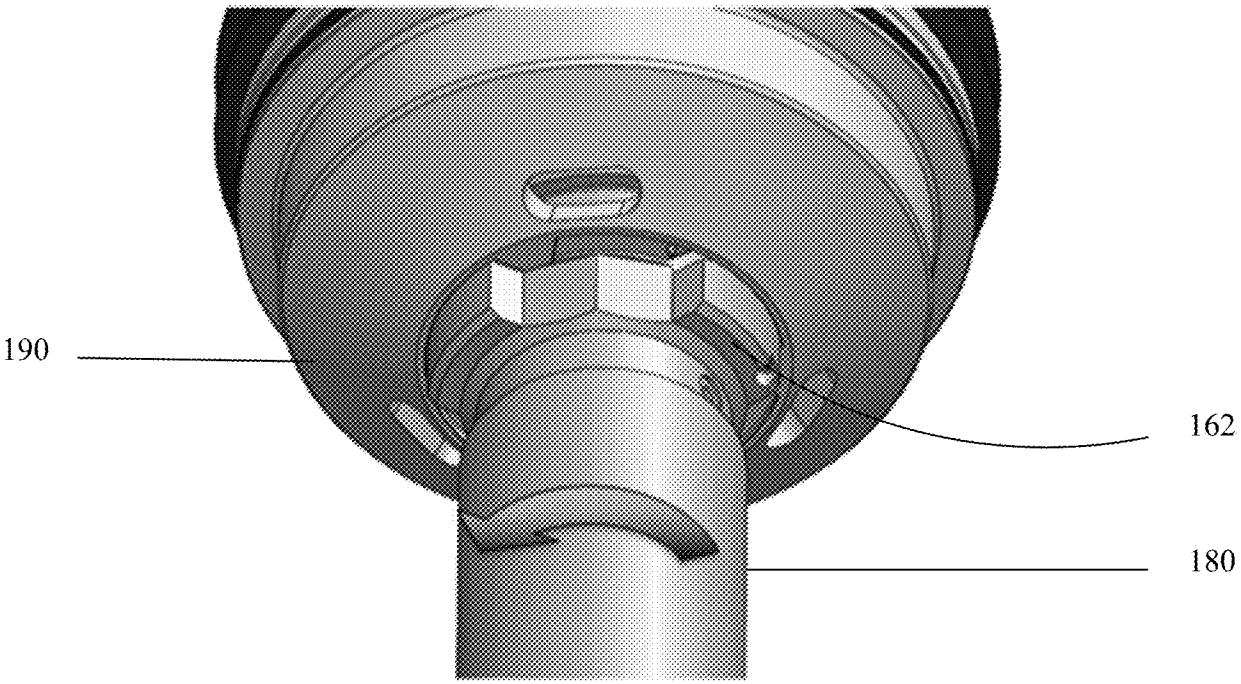
FIGS. 4A-4C show an embodiment of a process of activating a device.
Figure 4B:
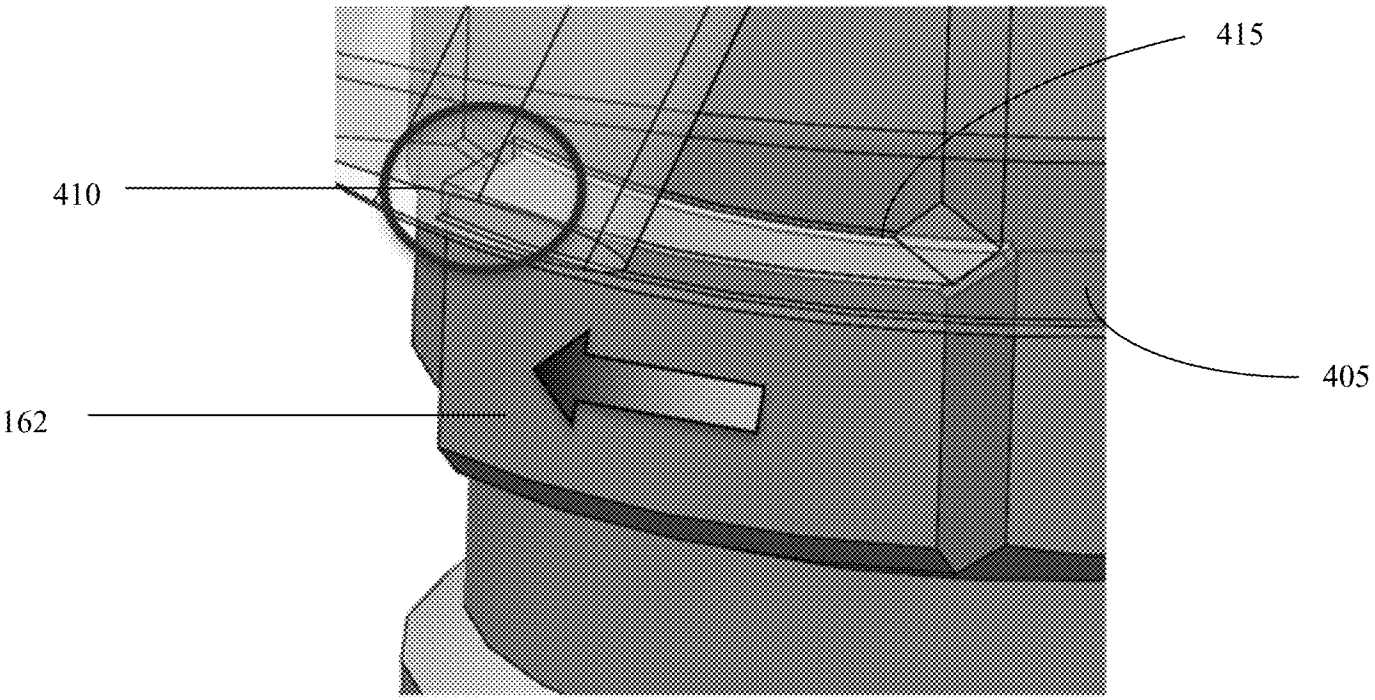
Figure 4C:
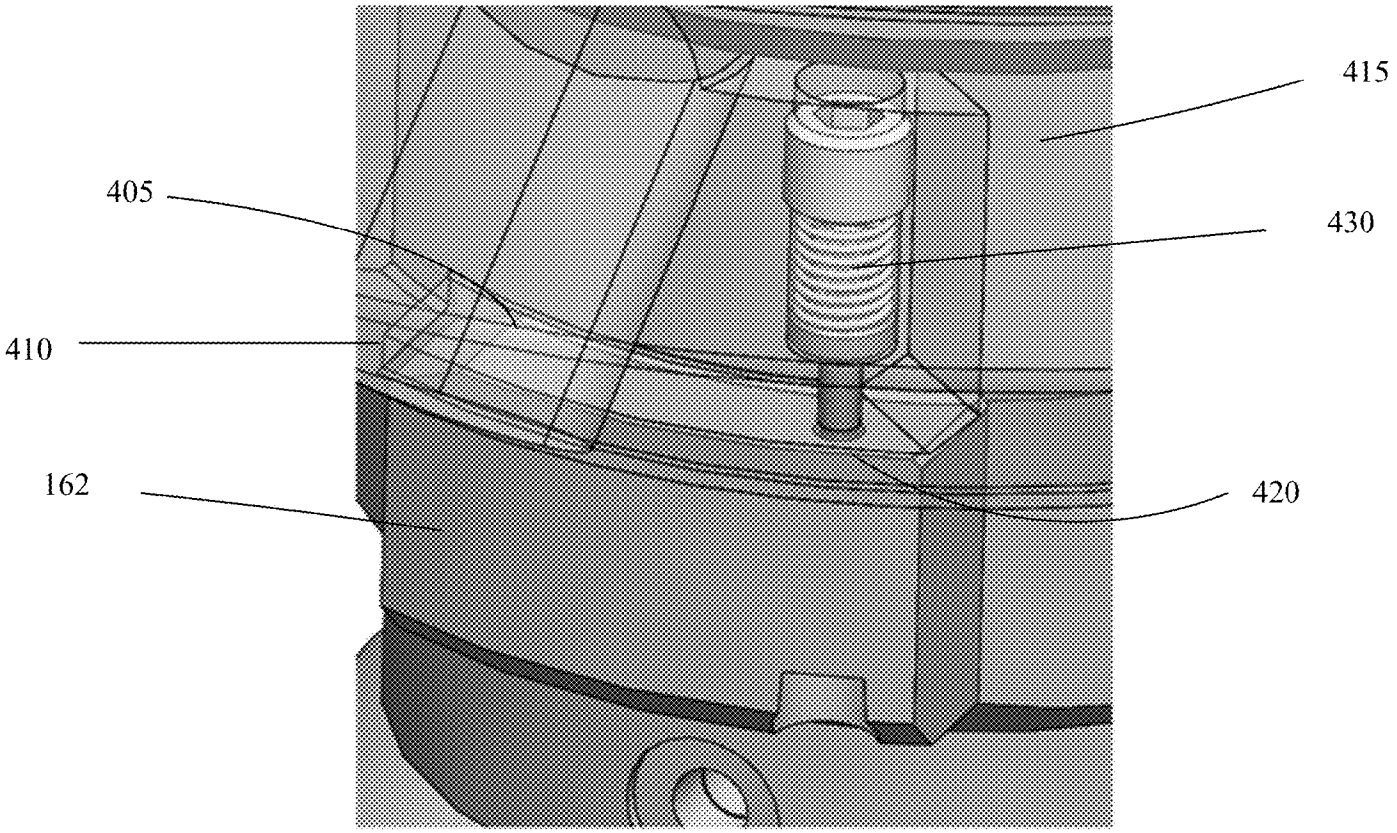

FIGS. 4A-4C show an embodiment of a process of activating a device. In particular, FIGS. 4A-4C show a process of locking the plug in an activated profile to maintain the actuation of the sealing and locking modules. The plug is similar to that described in FIGS. 1-3B. Common elements may not be described or described in detail.

As shown in FIG. 4A, the plug activation process weighs down the mandrel and displaces the stem portion 180 along with the multiple mandrel lugs. For example, the mandrel lugs are displaced to the bottom of the beveled base housing 415 and adjacent to beveled base latches 405. In one embodiment, the mandrel is rotated to displace multiple mandrel lugs into a multiple of beveled base latches 405 respectively. For example, the weighed down pin is rotated in a clockwise direction to rotate the lugs into the beveled base latches. In one embodiment, the inner flanged end 410 of the beveled base latch limits the degrees of rotation, as shown in FIG. 4B. For example, the inner flanged end 410 of the beveled base latch limits the mandrel lugs to a 50° degrees rotation in a clockwise direction. In one embodiment, continued rotation after 50° degrees creates torque buildup in the rotating apparatus (not shown) in communication with the running tool. Detection of torque buildup, for example, indicates sufficient displacement of the mandrel lugs and serves to stop the rotation. Rotating in other directions to engage the latches may also be useful. Having other limits of rotation may also be useful. For example, the length of the mandrel lugs or latch may determine the degree of rotation before torque buildup is formed.

As shown in FIG. 4C, one of the multiple mandrel lugs include a locking port 420 and one of the multiple beveled base latches include a spring-loaded shearing pin 430 housed above the latch and within the beveled base 190. For example, the mandrel lug with locking port is displaced into the beveled base latch with a spring-loaded shearing pin. In one embodiment, displacing the mandrel lugs 162 into the beveled base latch aligns the port 420 with the shearing pin 430. The compression spring provides a downward tension to mate the shearing pin with the port when the pin 430 and port 420 are aligned. Mating the pin 430 to the port 420, for example locks the mandrel lugs within the latch. The latched mandrel lugs, for example, restrains upward movement of the mandrel. For example, the plug is maintained in the activated profile after removal of the running pin from the plug.

Although only one locking port and one spring-load shearing pin is described, it is understood that more than one locking port and more than one spring-loaded shearing pin may be provided. For example, the configurations of locking port and shearing pin may depend on design requirement.

In one embodiment, the pin is retracted after activating the plug. For example, the pin is removed after the plug is activated to form a primary wellhead seal. In another embodiment, the activated plug forms a connection test plug. For example, the activated plug forms a BOP or riser connection test tool. Employing the activated plug to serve other functions may also be useful. For example, the activated plug may also serve as a drill string hang off tool. In one embodiment, the finning pin is slidably dismounted from the slotted interface of the conical cap. For example, the pin is dismounted in a reverse process of the mounting process. The relief of differential pressure on the valve shaft from the dismounted running pin displaces the valve shaft upward. In one embodiment, the valve shaft is displaced from a fully open check valve to form a closed check valve. For example, upward tension provided by the compressed compression spring 172 displaces the valve sealing element upwardly along with the beveled end 173 to energize against the inner profile of the valve assembly spring housing 174. In one embodiment, displacement of the valve sealing element to energize against the inner profile of the valve assembly spring housing closes the check valve.

Figure 5A:
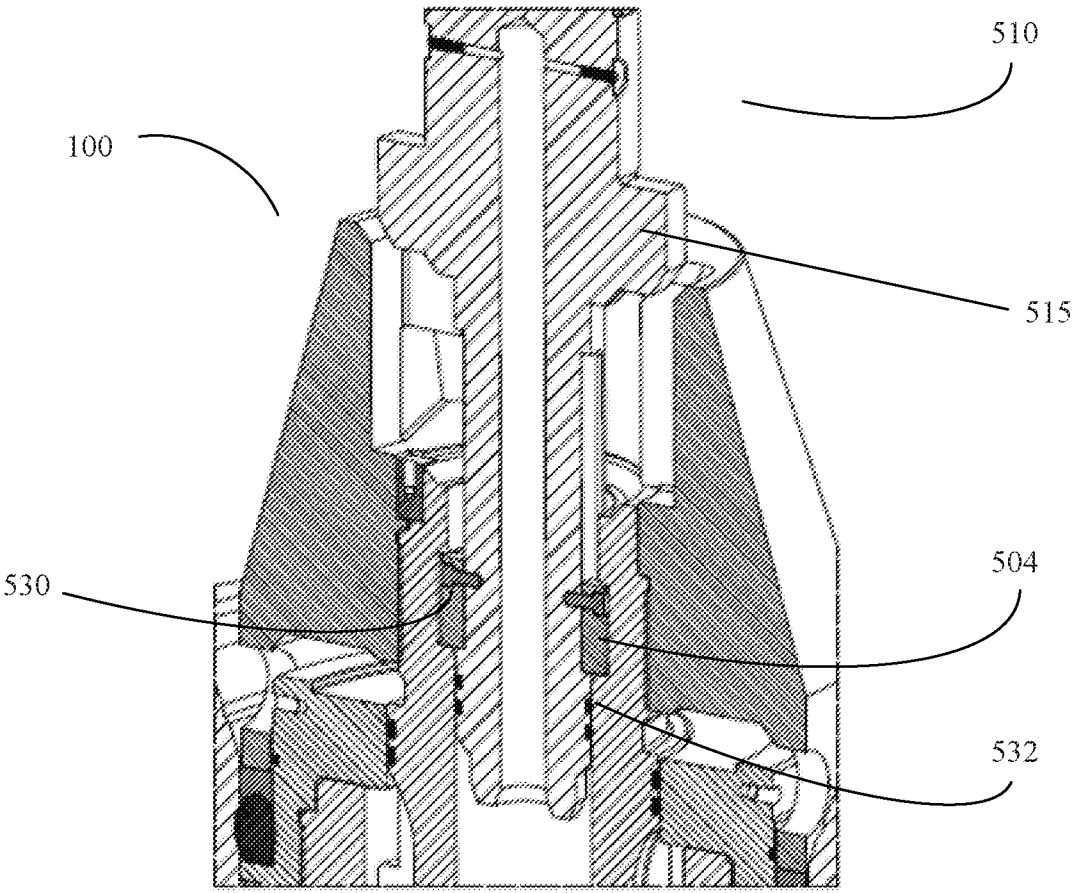
FIGS. 5A-5B show an embodiment of a process of performing a connection test.
Figure 5B:
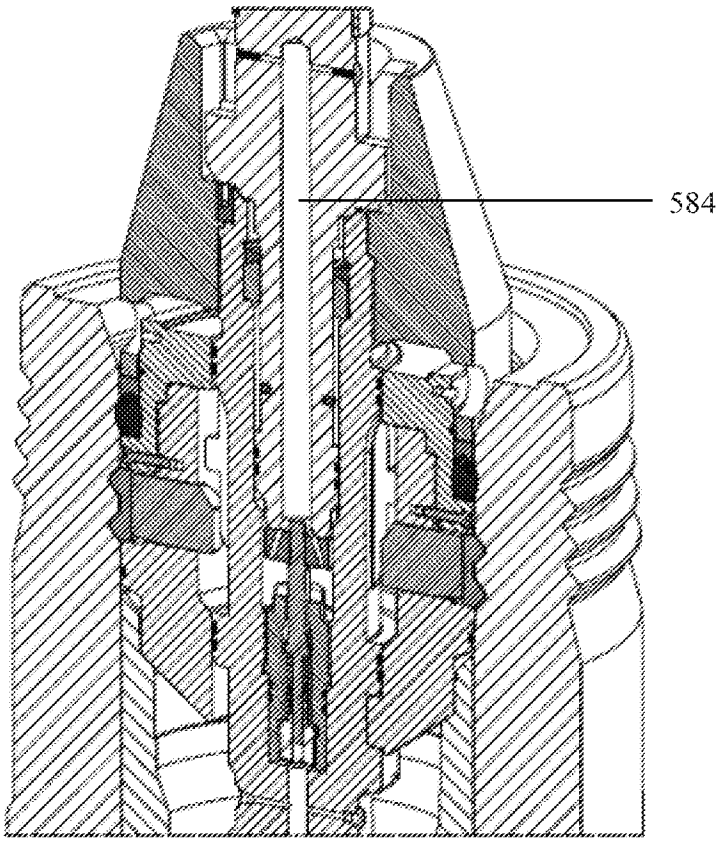

FIGS. 5A-5B show an embodiment of a process of performing a connection test. In particular, FIGS. 5A-5B show an activated wellhead sealing plug. In one embodiment, the wellhead sealing plug also serves as a BOP connection test tool. For example, the plug can serve as a test plug while being employed as a wellhead seal. The plug is similar to that described in FIGS. 1-4C. Common elements may not be described or described in detail.

FIG. 5A shows a tool partially mated to the mandrel. In one embodiment, the tool is a retrieval tool, such as a plug retrieval tool. In one embodiment, the retrieval tool includes a pair of sliding keys 504 abutting the retrieval pin 510. In one embodiment, the keys are slidably mounted into the mandrel slotted interface 136 by sliding downwardly along vertical grooves of the mandrel interface 136 in a first motion and a second motion rotates the pin to slide the keys along horizontal grooves. The second motion is, for example, a clockwise rotation. Rotating the sliding keys 504 in other direction, such as anti-clockwise direction may also be useful. For example, the keys 504 are rotated about 30-60 degrees to latch within the horizontal grooves of the slotted interface. In one embodiment, an upward tension is generated after rotating the keys 504 into the grooves. For example, the upward tension provides a functional test to ensure that the keys 504 are securely latched within the horizontal grooves.

In one embodiment, the retrieval pin includes a pair of radial grooves for seating two sealing elements 532. In one embodiment, the retrieval pin sealing elements are disposed between the sliding keys and the retrieval pin nose. The sealing elements, for example, energize against the inner diameter of the mandrel hollow profile. For example, the sealing elements 532 form pressure seals within the mandrel hollow profile when the sliding keys are securely mounted into the horizontal grooves of the mandrel slotted interface. In one embodiment, sealing elements of the retrieval pin, first mandrel shoulder and upper plug body form an upper blind. For example, the sealing elements, in combination or combination thereof, may form a pressure seal against uphole pressure. The uphole pressure seal, for example, allows BOP connection test with a test pressure of up to about 15,000 PSI. Other types of tests may also be performed. For example, the pressure seal may also allow riser connection test. Other test pressures may also be useful.

In one embodiment, each sliding key includes a shearing pin 530 which locks the keys in position along the outer circumference of the retrieval pin. The shearing pin is designed to shear or break under sufficiently tension. In one embodiment, the shearing pin is sheared under the weight set of the retrieval string. For example, the weight set of the retrieval string is released under controlled conditions to weigh down on the retrieval pin and shear the shearing pin. The retrieval pin includes a pair of angular abutments 515 disposed above the sliding keys. The angular abutments are, for example, similar to those of the running pin 210.

In one embodiment, breaking the shearing pin allows the retrieval pin 510 disposes the sliding keys within the horizontal grooves of the mandrel interface. For example, the pin 510 is disposed further into the hollow profile of the mandrel. In one embodiment, that the angular abutments 515 are displaced downwardly along with the pin 510 and landed on the cap 110. In one embodiment, the weighed down retrieval pin is rotated to slide the angular abutments along the cap opening to locate the vertical grooves of the cap slotted interface. For example, angular abutments of the weighed down retrieval pin are rotated clockwise to engage into the vertical grooves of the slotted interface. Rotating the pin on other directions, such as anti-clockwise may also be useful. Locating the vertical grooves allows the retrieval pin to be lowered further into the hollow profile of the annular mandrel. In one embodiment, the weighed down retrieval pin is fully mated with the mandrel, as shown in FIG. 5B.

In one embodiment, an upward tension is provided by excess downhole pressure. For example, fluid and/or gas pressure buildup from the wellbore below the plug forms a downhole pressure of up to about 15,000 PSI on the check valve. In one embodiment, a downward tension is sufficient to overcome the upward tension from downhole pressure and displace the valve shaft downwardly. For example, the retrieval string provides a downward tension of at least about 9 metric ton to overcome the upward tension of the check valve. In one embodiment, sufficient differential pressure from the weighed down pin 510 displaces the valve shaft to form an open check valve and enables the pin 510 to fully mate into the mandrel. For example, the beveled end along with the valve sealing element is fully displaced away from the inner surface of the spring housing to open the ventilation pathway. The ventilation pathway serves to relieve excessive pressure from build-up of gas, liquid or a combination thereof. Opening the check valve allows excess downhole pressure to be relieved upwardly through the retrieval tool. In one embodiment, trapped wellbore pressure is channeled upwardly from the axial bores and/or annular channels of the stem portion, through the valve assembly and into the pressure duct 584 of the retrieval pin. In one embodiment, the retrieval pin includes a pair of one-way pressure relief valves in communication with the pressure duct 584. For example, the pair of relief valves channels the excess gas and/or liquid pressure to a suitable containment unit. In one embodiment, equalization of downhole pressure allows the plug to be safely retrieved.

FIGS. 6A-6D show an embodiment of a process of retrieving a device. In particular, FIGS. 6A-6D show a process of retrieving an activated wellhead sealing plug from a wellhead. The plug is similar to that described in FIGS. 1-5B. Common elements may not be described or described in detail.

Figure 6A:
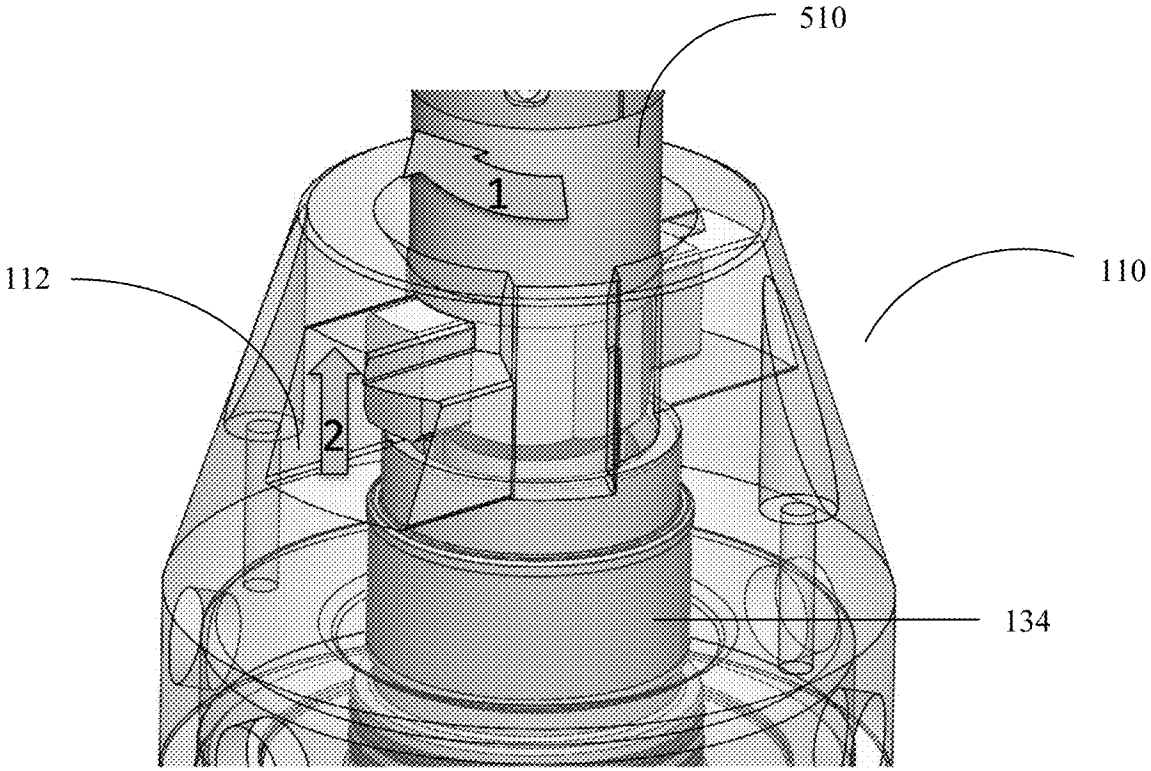
FIGS. 6A-6D show an embodiment of a process of retrieving a device.

In one embodiment, the plug retrieval process continues after equalizing trapped downhole pressure, as described in FIG. 5B. In one embodiment, the angular abutments of the retrieval pin are slotted into the vertical grooves of the slotted cap interface. In one embodiment, the pin is rotated in a clockwise direction to slide the abutments along the horizontal grooves of the slotted interface 112 in a first motion. For example, the pin is rotated to contact with the sidewall of the horizontal grooves. In one embodiment, rotating the pin against the groove sidewall forms torque buildup in the rotating apparatus in communication with the retrieval pin. For example, pin rotation is stopped after torque buildup is detected. A second motion pulls the abutments upward into a latch of the interface 112, as shown in FIG. 6A.

Figure 6B:
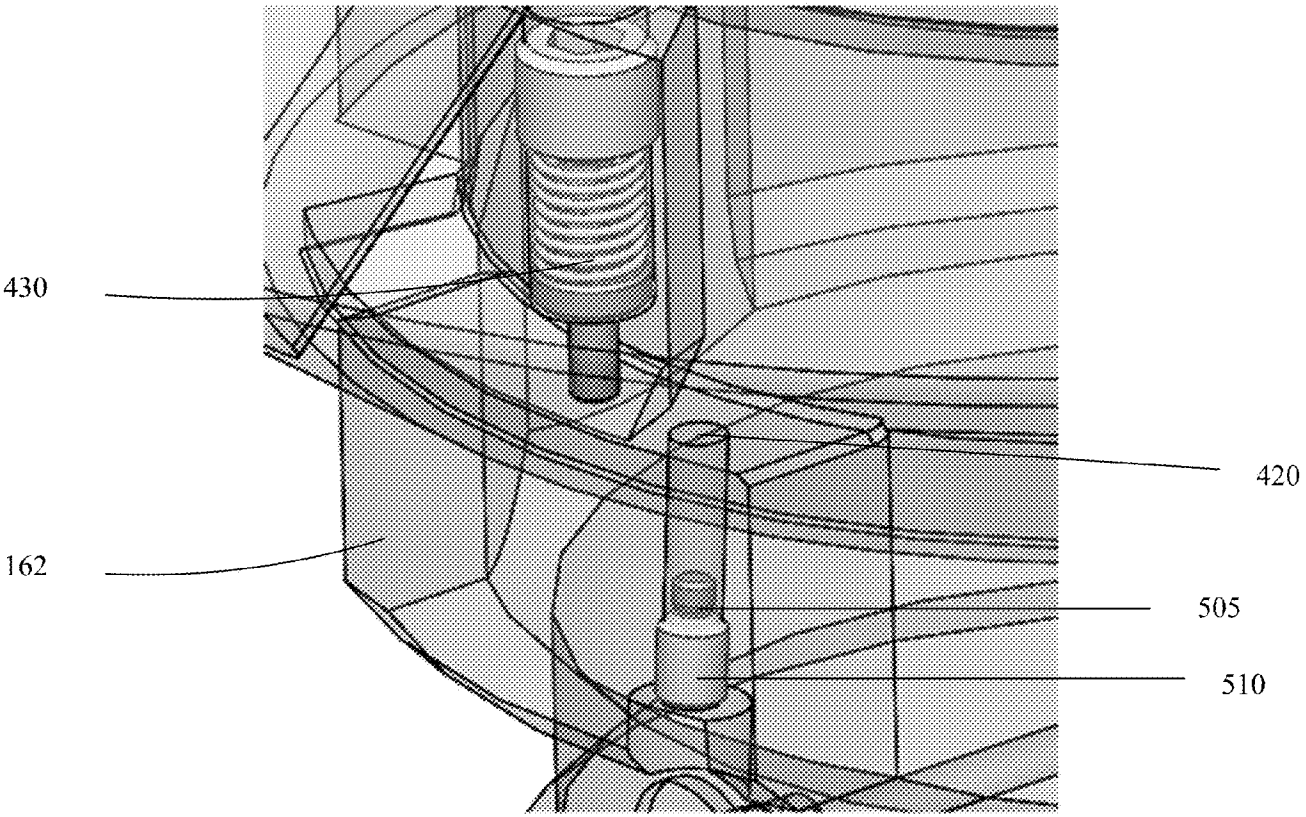
Figure 6C:
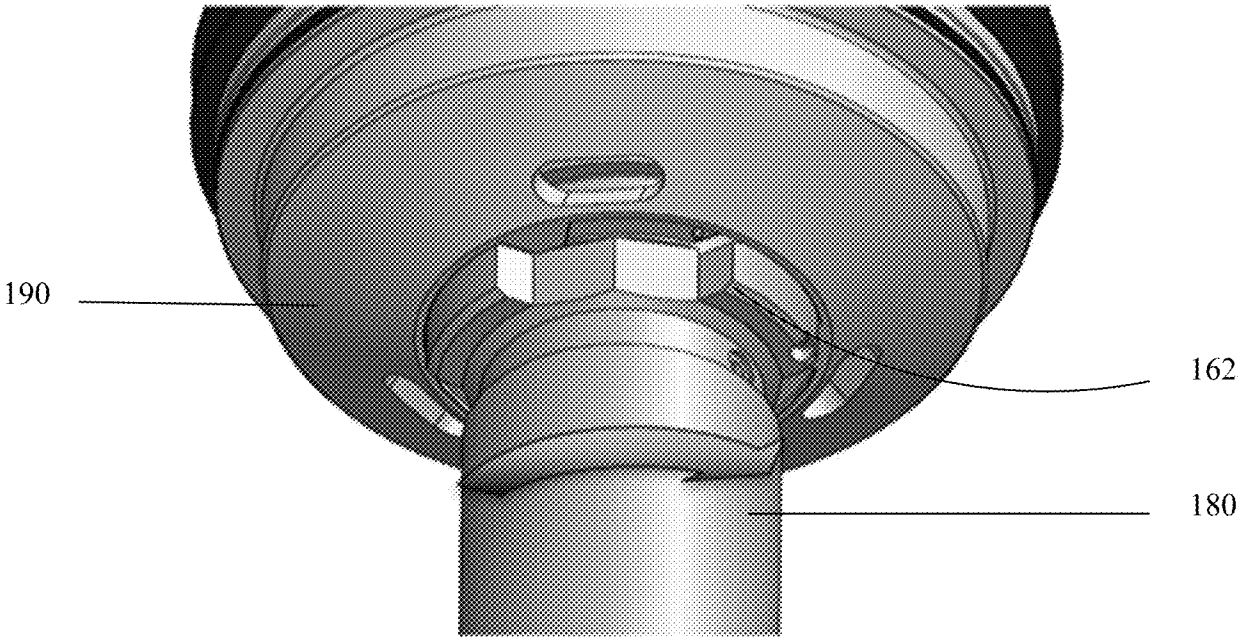

Continuous upward tension on the pin keep the abutments engaged within the latch. In one embodiment, the latched pin is rotated in an anticlockwise direction to rotate the mandrel along with the cap. Rotation of the mandrel forcibly shears the mated spring-loaded shearing pin 430 against the locking port 420. The sheared pin portion 505 is disposed within the enclosed port, as shown in FIG. 6B. For example, a port plug 510 is disposed to enclose a bottom end of the port 420. In one embodiment, the mandrel is rotated 50° anticlockwise to displace the lugs from within the beveled base latch to the bottom of the beveled base housing, as shown in FIG. 6C. For example, the lugs are rotated out of the beveled base latch to allow upward movement of the mandrel.

Figure 6D:
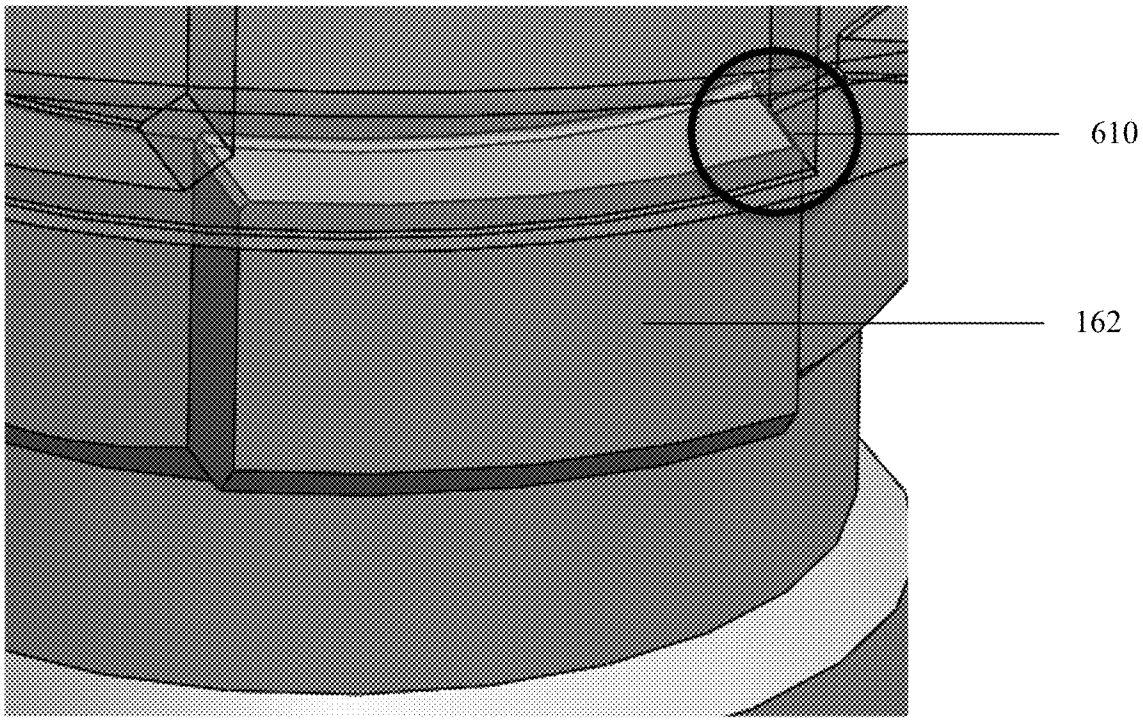

In one embodiment, a bottom wall portion of the beveled base housing limits the mandrel lugs to a 50° degree of freedom in an anticlockwise direction. For example, the wall portion is an inner flanged end disposed opposite of the beveled base latch and aligned to the wall of the beveled base housing, as shown in FIG. 6D. In one embodiment, the wall is in contact with the rotated lugs and continued rotation causes a torque buildup in the rotating apparatus in communication with the mandrel. For example, detection of torque buildup stops the retrieval pin from further rotation.

In one embodiment, displacement of the lugs allow upward tension from the pin to displace the annular mandrel and conical cap upwardly into an unlock profile. For example, removal of differential pressure from the metal gauge ring de-energizes the first sealing member and the upward movement of the mandrel slides the mandrel hangers upwardly to rest on the wedge end of the support dogs. The inward biased locking module is retracted into the outer circumference of the plug and disengaged from the wellhead annular grooves. For example, the plug is unlocked for retrieval. The unlocked plug has an unlock plug profile similar to that described in FIGS. 1B and 2B. In one embodiment, the plug is retrieved for redeployment. For example, the plug may be used repeatedly for sealing other wellheads.

The present disclosure holds several advantages over current technology. As described, a locking module locks the plug in its functional position and supports operational loads, such as pressure load and hanging load. Multiple sealing elements serve to minimize potential leakage pathways. The plug effectively forms a wellhead pressure barrier, sealing the well bore against downhole and uphole pressures, and performs a multiplicity of functions. In one embodiment, the plug serves as a wellhead pressure seal and enables the BOP to be retrieved during an emergency quick disconnection (EQD) procedure. In one embodiment, the plug functions to hang off the drill string and seal off a temporarily abandoned subsea well in another embodiment, the plug functions as a BOP and riser connection test tool during a reconnection procedure with the sealed well prior to plug retrieval. This avoids the necessity of installing a separate test plug.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A device comprising:

a plug provided with a cap portion having a slotted interface, wherein the slotted interface of the cap portion comprises vertical and horizontal grooves;

a plug body attached below the cap portion, the plug body comprises an upper and lower plug body, wherein a locking module is disposed between the upper and lower plug body;

a first sealing member disposed on an outer circumference of the upper plug body, wherein the first sealing member is a de-energized bulk sealing member which is energized by a downward load to provide a sealing function which seals a space directly between an inner surface of a wellhead and the plug body;

an annular mandrel, an upper portion of the mandrel is housed within the conical cap and plug body, wherein a lower portion of the mandrel includes a stem portion extending out of the lower plug body; and a valve assembly disposed within a hollow profile of the mandrel.

2. The device of claim 1 wherein the locking module is an expandable open lock ring.

3. The device of claim 2 wherein an anti-rotational component is disposed within the opening of the lock ring.

4. The device of claim 1 wherein multiple support dogs are disposed between the annular mandrel and the locking module.

5. The device of claim 4 wherein displacement of the support dogs away from the mandrel expands the locking module radially outwards.

6. The device of claim 5 wherein the expanded locking module locks the plug in a functional position within a wellhead.

7. The device of claim 1 comprising a second sealing member disposed on an outer circumference of the lower plug body, wherein the second sealing member provides a sealing function to seal the space directly between an inner surface of the wellhead and the plug body.

8. The device of claim 7 wherein the first sealing member contacts the inner surface of the wellhead to form a primary uphole pressure seal and a secondary downhole pressure seal.

9. The device of claim 7 wherein the second sealing member contacts the inner surface of the wellhead to form a primary downhole pressure seal and a secondary uphole pressure seal.

10. The device of claim 1 wherein:

the stem portion of the annular mandrel comprises a first axial bore and a second axial bore narrower than the first axial bore; and first and second annular channels disposed adjacent to and in communication with the second axial bore.

11. The device of claim 10 wherein:

the valve assembly comprises a valve sealing element disposed within a valve housing; and the valve housing is in communication with the first and second axial bores and annular channels.

12. The device of claim 11 wherein the valve assembly controls an opening or closing of a ventilation pathway within the mandrel.

13. The device of claim 1 wherein the lower portion of the mandrel includes a threaded connection pin disposed at a bottom end of the stem portion, wherein the threaded connection pin provides a connection to a drill string or a bottom hole assembly (BHA).

14. The device of claim 1 wherein the vertical and horizontal grooves in the slotted interface of the cap portion comprises a horizontal groove in communication with a shallow vertical groove disposed atop an end of the horizontal groove, wherein the shallow vertical groove serves as a latch for engaging a running tool.

15. The device of claim 1 wherein the vertical and horizontal grooves in the slotted interface of the cap portion comprises a J-slot interface configuration.

16. A method for using a device comprising:

using a running tool to insert a wellhead plug into a wellhead housing;

landing the plug within the wellhead housing, wherein the plug is landed on a landing shoulder disposed below a wellhead opening;

applying a downward load on the running tool to activate a locking module and first and second sealing members of the plug to form a wellhead pressure seal, wherein activating the locking module also activates the first sealing member;

rotating a mandrel to lock the plug in an activated profile within the wellhead housing, wherein the running tool is removed from the activated wellhead seal, a valve assembly disposed within a hollow profile of the mandrel controls an opening or closing of a ventilation pathway; and wherein during a plug retrieval process, a retrieval tool contacts the valve assembly and opens the ventilation pathway to equalize excess downhole pressure in the sealed wellhead.

17. The method of claim 16 wherein the first sealing member forms a primary pressure seal for a blowout preventer (BOP) connection test.

18. The method of claim 16 wherein the second sealing member forms a primary pressure seal against wellbore pressures.

19. The method of claim 16 wherein the locking module locks the plug in a functional position and provides support for pressure loads or hanging loads.

20. A device comprising:

a plug provided with a protective cap portion having a slotted interface;

a plug body attached below the cap portion, the plug body comprises upper and lower plug body, wherein a locking module is disposed between the upper and lower plug body;

an annular mandrel comprising a first axial bore and a second axial bore narrower than the first axial bore, an upper portion of the mandrel is housed within the conical cap and plug body, wherein a lower portion of the mandrel is exposed below the lower plug body;

first and second annular channels disposed adjacent to and in communication with the second axial bore of the annular mandrel;

a valve assembly disposed within a hollow profile of the mandrel, the valve assembly comprises a valve sealing element disposed within a valve housing, wherein the valve housing is in communication with the first and second axial bores and annular channels; and wherein the valve sealing element serves to open or close a ventilation pathway, wherein an open ventilation pathway relieves excess downhole pressure in a sealed wellhead.

* * * * *